US006023868A

United States Patent [19]

Viodé et al.

[11] Patent Number: 6,023,868

[45] Date of Patent: Feb. 15, 2000

[54] DEVICE FOR SELECTIVELY DISPLAYING INFORMATION

[75] Inventors: Alain Viodé, Carmaux; Frèdéric Houache, Lévy St Nom; Thierry Costes; Gérard Bardou, both of Lasserre; Francis Martinez, St. Lizier, all of France

[73] Assignee: S.C. Rollerblade, Lasserre, France, Lasserre, France

[21] Appl. No.: 08/676,298

[22] PCT Filed: Jan. 17, 1994

[86] PCT No.: PCT/FR94/00052

§ 371 Date: Sep. 12, 1996

§ 102(e) Date: Sep. 12, 1996

[87] PCT Pub. No.: WO95/19618

PCT Pub. Date: Jul. 20, 1995

[51] Int. Cl.[7] ..... G09F 11/10

[52] U.S. Cl. ..... 40/515; 40/514

[58] Field of Search ..... 40/514, 515, 516

[56] References Cited

U.S. PATENT DOCUMENTS 1,700,435 1/1929 Duval .
2,188,185 1/1940 Hutchinson ..... 40/516
2,195,249 3/1940 Hutchinson .

FOREIGN PATENT DOCUMENTS 21474 10/1915 Denmark ..... 40/516
2 647 246 11/1990 France .
182964 8/1922 United Kingdom .

*Primary Examiner*—Cassandra H. Davis
*Attorney, Agent, or Firm*—Hardaway/Mann IP Group

[57] ABSTRACT

A selective information display device having a self-supporting frame comprising an upper magazine and a lower magazine adapted to store rolls containing rolled up informational posters, each poster equipped at one of its ends with an elastic return which ensures the rolling up of the poster inside its roll without any external action, and on the other end with an outer extract assembly allowing an opposing force of the elastic return to be counteracted, and the unrolling of the posters out of their rolls. The device also comprising at least one display window allowing the display of information on the poster unrolled behind it and at least one unwinder equipped with a pair of hooks arranged facing each other and acting to hook the outer extracting assembly for extracting the posters from their rolls, thus, ensuring the unrolling of one poster behind the window at the same time as the rolling up of another poster having just been displayed.

14 Claims, 4 Drawing Sheets

DEVICE FOR SELECTIVELY DISPLAYING INFORMATION

This invention is related to a selective information display device used for advertising.

The changing needs of operators of display devices have made technique progress in this area, and today there are various processes allowing several pieces of information to be displayed successively.

The current advertising market, in particular where heavily publicized events are involved, does not find a suitable response to its needs in the use of such devices. Indeed, it has become indispensable to optimize the return of a poster campaign by having available means whose implementation is simple, rapid, and costs little, while offering a great amount of flexibility in the choice and modification of the order and duration of display.

The invention applies more specifically to display devices of the type of those which are composed of:

a magazine for storage of rolls containing informational posters on rolled up supple strips, a display window allowing the display of information of a poster unrolled in front of it, and an unwinder allowing selective unrolling of the posters out of their rolls and behind the display windows.

Each of the posters is equipped at one of its ends with an elastic return means (such as a spring) ensuring the rolling up of the poster inside its roll without any external action, and at the other end, with an external means for extracting against the opposing force of the return means and unrolling the said poster out of its roll.

The French patent No. 2 647246 proposes a solution to carry out such a display device. To that end, this device comprises:

a conveyor (magazine) in a closed-loop arrangement, driven by a motor and guided so as to pass in front of a display window, a plurality of supports distributed along the conveyor and immovably attached thereto, each of these supports being intended to a receive a cartridge (roll) positioned at right angles to the travelling axis of the conveyor.

means ensuring a disconnectable fastening of the said cartridges on said supports, retention means (unwinder) arranged permanently in a space situated in front of the path of the means for extracting the posters, when the cartridges are driven by the conveyor and in the vicinity of the display window.

means to control the motor and select posters that are capable of acting on the retention means, with a view to cause the unrolling of the poster in the area of display under the effect of the driving of the cartridge by the conveyor and to halt the conveyor when the poster is completely unrolled.

This device presents the drawback of not allowing direct access to a poster without having to make all of the posters which preceded it on the conveyor travel in one direction or the other, once the poster displayed behind the window has been disconnected from the retention means so that it can be put away in its cartridge.

The technical problem to be solved by the object of the present invention is thus to propose a display device that is easy to implement, costs little, allowing an easy definition and modification of the order and duration of the display of each poster and a maximal reduction in unproductive time between the operations of poster removal and display.

To respond to this problem, the fundamental concept of the invention consists in using a display device of the type summed up above and consisting of a self-supporting frame having two magazines for storing rolls arranged at its ends, behind the display window and on the level of the latter, in such a way that the aforesaid unwinder can ensure the unrolling of the poster or a magazine behind the window at the same time as the rolling up of the poster of the other magazine having just been presented and vice-versa.

Such a display device offers numerous advantages because it allows one to reduce to the minimum the unproductive time between the operations of poster removal and display since:

during the display time of one poster of one magazine behind the display window, another poster is selected in the other magazine, the unrolling of a poster of a magazine takes place at the same time as the rolling up of a poster having just been displayed by the other magazine.

Further, it allows a non-defined order of scrolling of the posters.

According to a particularly advantageous feature of the invention, the aforesaid unwinder moves from one end of the self-supporting frame where one magazine is installed (known as first magazine) toward the opposite end where the other magazine (known as second magazine) is installed. This unwinder is equipped with a hanging device for the means to extract the posters out of their roll, in such a way that, when the unwinder is set in motion from the first magazine toward the second magazine, it ensures, behind the display window, the rolling up of the poster of the second magazine at the same time as the unrolling of the poster of the first magazine, and when the unwinder is set in reverse motion it ensures the rolling up of the poster of the first magazine at the same time as the unrolling of the poster of the second magazine.

Compared with earlier devices, the unwinder is dynamic since it is the part that comes in front of the means for extracting a poster selected from one magazine or the other and which ensures the unrolling and the display of a poster behind the window.

According to the main embodiment of the invention, the unwinder also guides the rolling up of the poster within its roll, at the same time as the unrolling of the next poster.

The device of the invention offers a notable advantage in that the roll storage magazines containing the posters and the unwinder are dynamic. A judiciously programmed interaction between them by the control electronics of the driving motors will allow the minimization of unproductive time.

According to a preferred embodiment of the invention allowing the best optimization of the display surface of the device of the invention, it is possible to provide a device having two display windows and two unwinders arranged on either side of the two magazines. In particular, this application will be useful when the display device is installed such that the two windows are exposed to public view.

As the invention has just been mentioned above in its most elementary form, other features and advantages shall become more clear when one reads the description which follows, giving, as a non-restrictive example, an embodiment of a display device illustrating the fundamental concepts of the invention.

Drawings are appended to this description, in which.

FIGS. 5*a*, 5*b*, 5*c*, 5*d* are schematic views of this device, illustrating a display cycle.

Figure 1:
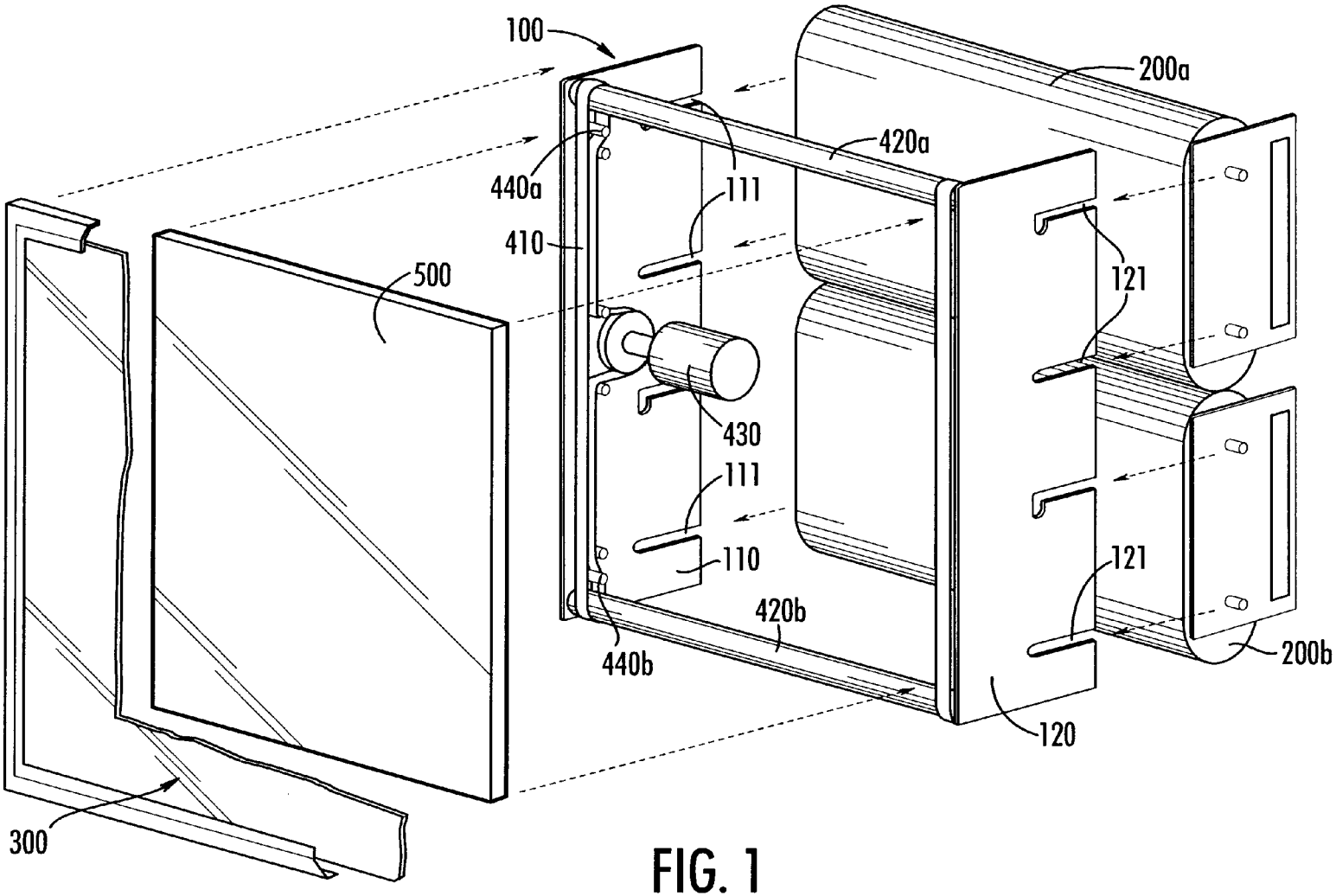
FIG. 1 is a partially exploded view of such a device.
Figure 2:
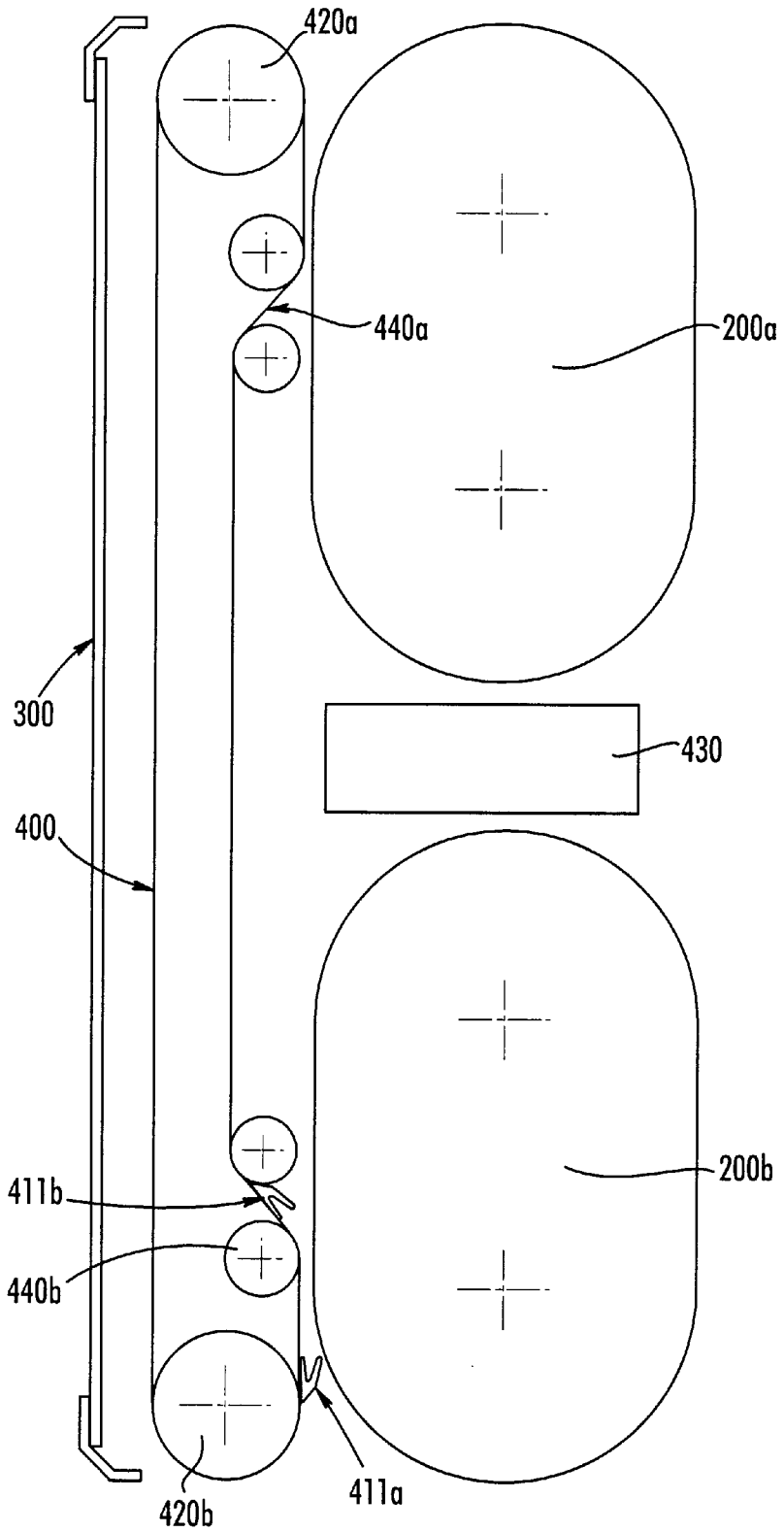
FIG. 2 is a vertical cross-section view of the same device.

As represented on the drawings on FIGS. 1 and 2, the display device of the invention consists of a self-supporting frame 100 on which are laid out:

two magazines 200*a* and 200*b* for storage of rolls 210 and 220.

a display window 300, and an unwinder 400.

The self-supporting frame 100, which will be described in further detail at the end of the description, is specifically made up of a rigid frame whose purpose is to serve as a logical structure for the different dynamic organs of the device (the construction whereof will be explained in detail hereinafter) adapted to be interchangeable and to respect the modular architecture.

The purpose of the magazines 200*a* and 200*b* which, in the context of the invention, are located at the top and bottom of the frame 100 is to ensure the dynamic storage of rolls 210*a*, 210*b* containing the rolled up advertising posters 211*a*, 211*b*.

Figure 3:
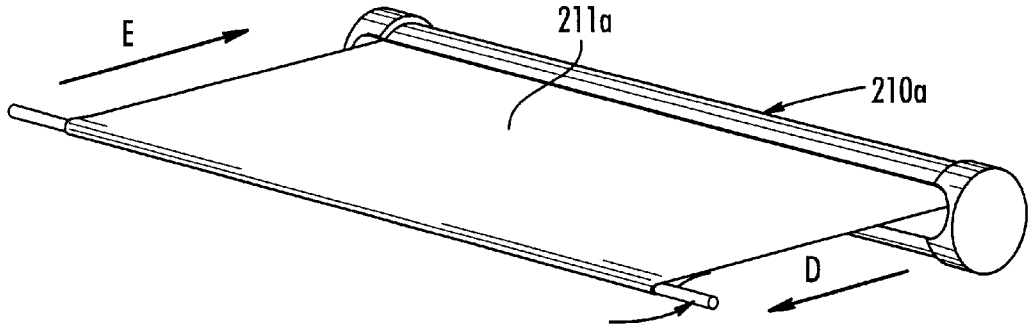
FIG. 3 is a detail view of one element of this device.
Figure 4:
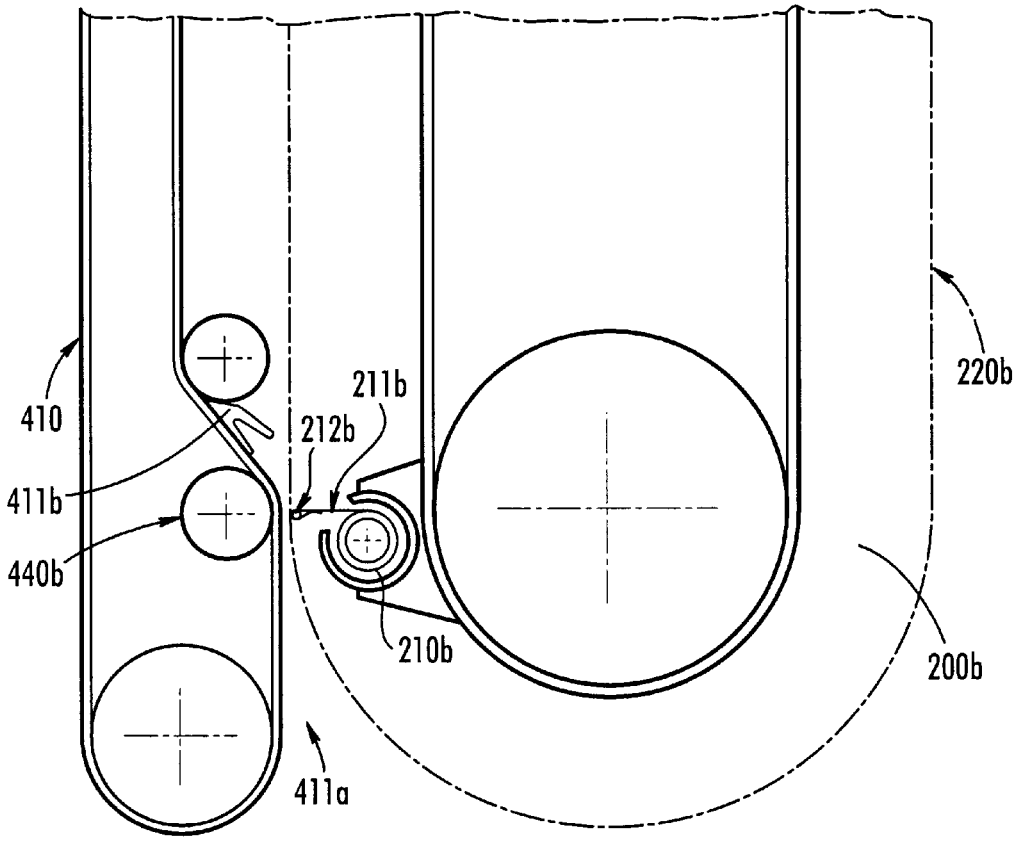
FIG. 4 is an enlarged view of a detail of an embodiment of this device.

As shown on FIG. 3, the poster 211*a* illustrated as an example on the drawing of FIG. 3 is equipped at one of its ends with an elastic return means which is not illustrated, which particularly ensures an automatic rolling up of the poster within its roll 210*a* without any external action. This elastic return can be made of a spiral-type spring wedged between the case of the roll and an axle mounted in free rotation on which is fastened one end of said poster.

The other end of the poster 211*a*, situated outside of the case of roll 210*a*, is preformed in a hem in which there is inserted a rod 212*a* acting as a means for extracting which, with the help of an appropriate hanging means, allows opposing the return means of the spring to be counteracted and the unrolling of the poster 211*a* out of its roll 210*a*. Thus, when one acts on the rod 212*a* in the direction shown by arrow D, the poster 211*a* is unrolled out of its roll 210*a* while kept taut by the opposing tension exerted by the force of return E of the spring. When the action of the effort of extracting is canceled, the return effort of the spring ensures the rolling up of the poster 211*a* inside roll 210*a* as shown by arrow E.

To ensure dynamic storage of posters 211*a*, 211*b*, the magazines 200*a* and 200*b* are each made of an endless chain 220*a* (not shown but identical to 220*b*) and 220*b*, each driven around the two rollers of which at least one is a driving roller. The purpose of these endless chains 200*a* and 220*b* is to accommodate (preferably in a removable manner) rolls 210*a* and 210*b* containing posters 211*a* and 211*b*. The purpose of the rotary drive of the endless chains around their reversing rollers is to be able to present before the unwinder a roll 210, whatever its position in the magazine may be.

The embodiment of the magazines 200*a* and 200*b* is given as a preferred example of embodiment because the reversal of the endless chains around their rollers allows the availability of all of the useful height freed behind the display window 300, while reducing the thickness of the frame imposed by the diameter of the said rollers. When the number of posters is smaller, it is possible to replace the magazines 200*a* and 200*b* with two drums or barrels receiving rolls 210*a* or 210*b* peripherally.

Magazines 200*a* and 200*b* thus defining independent modular sets can also be interchanged quickly in the display device of the invention. To do this, the flanges 110 and 120 provided with cross members, making up the self-supporting frame 100 of the device are equipped with notches 111 and 121 opening toward the back of the frame and allowing the quick putting in or removal of a magazine 200*a* or 200*b*.

The display window 300 allowing the display of information of the poster 211*a* or 211*b* unrolled behind it, is also fastened interchangeably on the flanges 110, 120 of the frame 100, over nearly the whole height of the latter, determining the useful operating height. In special conditions of application, in particular in order to avoid the problems of reflection of incident light, the display window 300 can be without any protective glazing.

According to a preferred embodiment of the invention, the display device has an integrated lighted case 500 which fits into the thickness of the unwinder 400 in the free space between the reversing rollers 420*a*, 420*b*. This lighted case 500, placed at a distance from the window 300 to free a passage for the posters 211*a*, 211*b* being displayed, allows the latter to be lit up in back and possibly to reinforce the hold on the latter.

The unwinder 400 is arranged between the display window 300 and the two magazines 200*a* and 200*b*. It is made up of an endless strip 410 driven around two reversing rollers 420*a* and 420*b*, wedged between two flanges 110 and 120 of the frame 100 in the upper and lower parts thereof. A motor 430 ensures the driving of the endless strip 410 around said rollers 420*a*, 420*b*. According to the invention, the endless strip 410 is equipped with two hooks 411*a*, 411*b* arranged opposite each other and acting as a hanging means for the means for extracting the posters 211*a* or 211*b*. These hooks 411*a*, 411*b* are, on one hand, sufficiently spaced from one another, and, on the other hand, sufficiently open to allow the engagement or disengagement of the rod forming the aforesaid means 212*a* and 212*b* for extracting the posters 211*a*, 211*b*.

The number of pairs of hooks 411*a*, 411*b* distributed over the width of the endless strip 410, will be a function of the width of the posters 211*a*, or 211*b*. To that end, it is possible to position pairs of hooks at the two ends of the rod 212*a* 212*b* possibly going beyond the posters 211*a* or 211*b* and/or in the eyes provided on the length of the hem formed at the ends of the posters 211*a*, 211*b* to receive the said rods.

According to a preferred embodiment of the invention, the endless strip 410 of the unwinder 400 is equipped at its two ends, above the reversing rollers 420*a*, 420*b* with two means for guiding the strip 440*a*, 440*b*, each made up of two wheels laid out in an S shape, the two means for guiding being intended to define at the upper and lower points of the unwinder, a straight portion of the strip 410 above the curved portion of the endless chains of the aforesaid magazines 200*a* and 200*b*.

In particular, the advantage of guides 440*a*, 440*b* is that they tilt the hooks 411*a*, 411*b* to a given angle, thus improving the engagement and/or disengagement of rods 212*a*, 212*b* in the hooks. Another advantage of the guides 400*a*, 440*b* is the ability to make the posters scroll the whole height of the window 300 and to remove the hooks 411*a*, 411*b* from the trajectory of the rolls 210*a*, 210*b*, and to avoid any interference therewith. Furthermore, these guides are also used to detect the limit of travel of the endless strip 410.

Figure 5A:
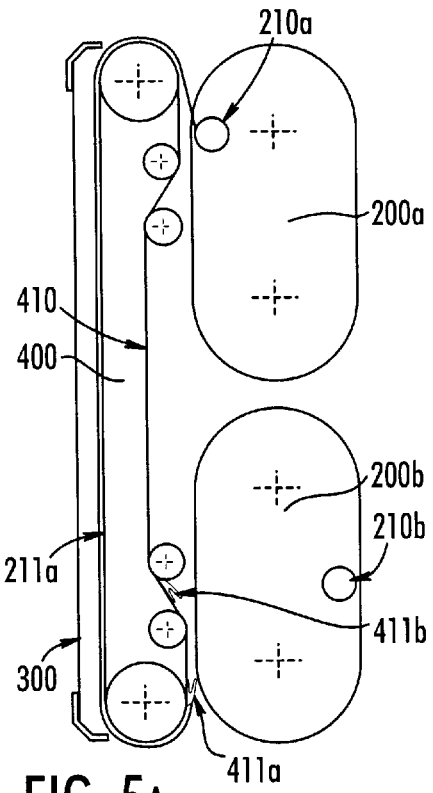

The display cycle of the above device is illustrated on the drawing of FIGS. 5*a*, 5*b*, 5*c*, 5*d* and functions in the following way:

The drawing of FIG. 5*a* illustrates the display device according to which a poster 211*a* of the storage magazine 200*a* is displayed behind the display window 300 and kept in this position by the hook 411*a* of the unwinder 400 at the bottom of the device at the level of magazine 200*b*. One will notice the illustration of a roll 210*b* situated in the magazine 200*b* and in which is rolled up the corresponding poster 211*b* that one wishes to display when the display of 211*a* is finished.

Figure 5B:
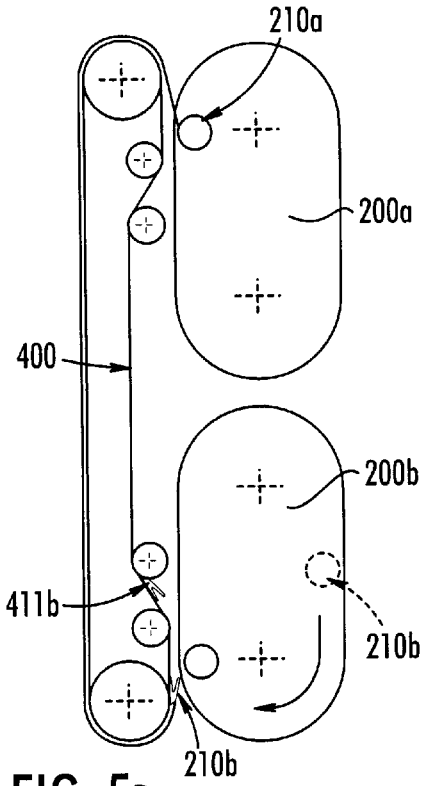

The purpose of FIG. 5*b* is to illustrate the setting in motion of the magazine 200*b* in such a way that the roll 210*b* is positioned in front of the hooks 411*a*, 411*b* of the unwinder 400.

Figure 5C:
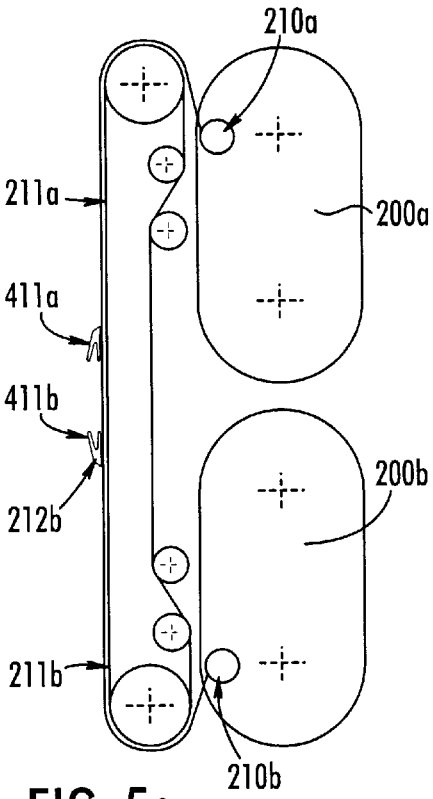

The purpose of FIG. 5*c* is to illustrate the setting in upward motion of the unwinder 400 which has allowed the hook 411*b* to ensure the hanging of the rod 212*b* corresponding to the selected poster 211*b* rolled up in the roll 210*b*, in such a way that the poster 211*b* can unroll behind the display window 300 at the same time as the poster 211*a* of the roll 210*a* of magazine 200*a* automatically rolls up in its roll under the effect of its return spring and guided by the upward motion of the unwinder 400.

Figure 5D:
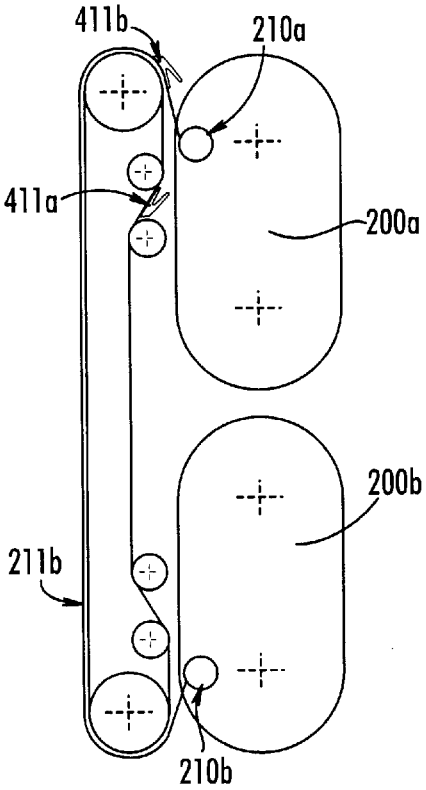

FIG. 5*d* illustrates the poster 211*b* completely unrolled behind the window 300 and the unhooking of rod 212*a* from hook 411*a*, so that the roll 210*a* is released from the unwinder 400. Then a new display cycle can begin for the positioning of a new poster in magazine 200*a*.

In conclusion, the device according to the present invention offers several advantages in comparison with existing devices:

It allows successive and rapid display of a very large number of pieces of information without external intervention.

It allows direct access to any one of the posters stored in the magazines.

It stores the posters in a minimal volume and offers a very small total size thanks to a frontal surface area almost identical to the useful surface area of the display window, as well as a depth greatly reduced by virtue of the dynamic storage of the magazines and by virtue of their composition.

Its implementation and maintenance are simple, reliable and cost little, in particular thanks to a very limited number of components, each one of which fulfills a function of which the implementation will be mastered by a person of the profession.

It allows changing the magazines in the device and changing the posters in the magazine.

It can be adapted to meet most of the requirements of the current information display market, in particular advertising information (vertical or horizontal scrolling, juxtaposition of several devices so as to obtain a display with large width or height, remote modification of the order and duration of travel of the posters, lighting, shock protection, absence of reflection, etc.).

Of course, the present invention is not limited to the embodiment described and encompasses all variants within the reach of specialists.

We claim:

1. Selective information display device used in advertising, composed of a self-supporting frame comprising:

an upper magazine and a lower magazine (200*a*, 200*b*) having rolls (210*a*, 210*b*) stored therein, said rolls containing rolled up informational posters (211*a*, 211*b*), wherein each of said posters is equipped at one of its ends with an elastic return means which ensures the rolling up (arrow E) of said poster (211*a*, 211*b*) inside its roll (210*a*, 210*b*) without any external action, and on the other end with an outer extracting means (411*a*, 411*b*) allowing an opposing force (arrow E) of the return means to be counteracted, and the unrolling (arrow D) of said poster (211*a*, 211*b*) out of its roll (210*a*, 210*b*);

at least one display window (300) allowing the display of information on said poster (211*a*, 211*b*) unrolled behind it;

at least one unwinder (400) equipped with a pair of hooks (411*a*, 411*b*) arranged facing each other and acting as a means for hooking the outer extracting means for extracting said posters (211*a*, 211*b*) from their rolls (210*a*, 210*b*), ensures the unrolling (arrow D) of one of said posters (211*a*, 211*b*) behind said window (300) at the same time as the rolling up (arrow E) of another of said posters (211*b*, 211*a*) having just been displayed, and vice versa, CHARACTERIZED IN THAT the at least one unwinder (400) is arranged in a space between said display window (300) and said upper and said lower magazines (200*a*, 200*b*) situated at an upper end and a lower end of said frame (100), and is made of an endless strip (410) driven around an upper reversing roller and a lower reversing roller (420*a*, 420*b*) situated at said upper end and the lower end, respectively, of said self-supporting frame (100), said endless strip carrying said pair of hooks opposite each other (411*a*, 411*b*) and traveling such that:

when the unwinder (400) is set in motion from said upper magazine (200*a*) toward said lower magazine (200*b*) on a display window (300) side, said pair of hooks (411*a*, 411*b*) travel on a portion of said endless strip (410) on a magazine side while engaging at least one of said pair of hooks (411*a*) opened upwardly in said means (212*a*) for extracting a poster (211*a*) of the upper magazine (200*a*), said pair of hooks passing around said upper reversing roller (420*a*) of the unwinder (400) and passing the display window (300) on the portion of said endless strip situated on a window side down to the lower reversing roller (420*b*) around which said pair of hooks turn in order to come in front of the lower magazine (200*b*);

and when the unwinder (400) is set in motion from said lower magazine (200*b*) toward said upper magazine (200*a*) on the display window side (300), said pair of hooks (411*a*, 411*b*) travel on a section of the endless strip (410) on said magazine side, engaging at least one of said hooks (411*b*) open toward the bottom in the means (212*b*) for extracting a poster (211*b*) from said lower magazine (200*b*), passing around said lower reversing roller (420*b*) of said unwinder (400) and traveling pass said display window (300) on the section of the strip situated on the window side up to said upper reversing roller (420*a*) around which said hooks pass in order to be positioned in front of the upper magazine (200*a*).

2. Device as per claim 1, CHARACTERIZED IN THAT said endless strip (410) of said unwinder (400) is assisted by a means for guiding, said means for guiding comprising a pair of offset rollers (440*a*, 440*b*), said endless strip (410) formed around said pair of offset rollers in an "S"-shape.

3. Device as per claim 1, CHARACTERIZED IN THAT it further comprises two display windows and two unwinders arranged on either side of said upper and said lower magazines.

4. Device as per claim 1, wherein said means (212*a*, 212*b*) for extracting a poster (211*a*, 211*b*) comprises a rod inserted within a preformed hem at an end of said poster (211*a*, 211*b*), CHARACTERIZED IN THAT the two ends of the rod (212*a*, 212*b*) standing out of said poster (211*a*, 211*b*) ensure a hold in said pair of hooks (411*a*, 411*b*) of said unwinder (400).

5. Device according to any of claims 1 through 4, CHARACTERIZED IN THAT said self-supporting frame (100) is made of a rigid frame formed by two lateral flanges with (110, 120) cross members acting as supports:

at a back portion, for said upper and the lower magazines (200*a*, 200*b*), said magazines removably mounted on said self-supporting frame by means of notches (111,

121) made in the flanges (110, 120) of the frame (100) opening toward the back portion;

at a middle portion, for said unwinder (400), said unwinder arranged between said display window (300) and said upper and the lower magazines (200*a*, and 200*b*), said unwinder comprising said endless strip (410) driven around said upper and said lower reversing rollers (420*a*, and 420*b*) wedged between said two flanges (110 and 120) of the frame (100) in an upper and a lower part of the frame; and at a front portion, for said display window (300), said window fixed in an interchangeable manner on said flanges (110, 120) on almost the whole of the frame, freeing a space with the unwinder (400) to allow the unrolling of a poster between them.

6. Device as per any of claims 1 through 4, further comprising a luminous case (500) inserted into the unwinder (400) in a space freed up between the reversing rollers (420*a*, 420*b*), and at a distance from the display window (300) so as to ensure passage of the posters (211*a*, 211*b*) traveling between them.

7. A selective information display device having a self-supporting frame which comprises:

an upper and a lower magazine having rolls with informational posters store therein, wherein said posters are equipped at a first end with an elastic return means and at a second end with an outer extracting means;

at least one display window for displaying information from said poster; and at least one unwinder having a pair of hooks for engaging said extracting means, wherein said unwinder is arranged between said display window and said upper and lower magazines, said unwinder further comprising an endless strip engaging an upper and a lower roller in communication with said frame.

8. A selective information display device according to claim 7 wherein said endless strip is guided by an arrangement of rollers located adjacent said upper and said lower rollers.

9. The selective information display device according to claim 8 wherein said rollers comprises a pair of offset rollers, said endless strip formed around said offset rollers in an "S"-shape.

10. A selective information display device according to claim 7 wherein said display window and said unwinder are arranged on either side of said upper and said lower magazines.

11. A selective information display device according to claim 7 wherein said outer extracting means further comprises a rod insertable within a hem at the end of said poster, said rod having ends protruding from said poster to engage said pair of hooks of said unwinder.

12. A selective information display device according to claim 7 wherein said self-supporting frame comprises two lateral flanges with cross members.

13. A selective information display device according to claim 12 wherein said lateral flanges further comprise notches for removably mounting said upper and said lower magazines onto said self-supporting frame.

14. A selective information display device according to claim 7 further comprising a luminous case inserted between said endless strip of said unwinder and at a distance from said display window to ensure passage of said posters.

* * * * *